US005199115A

United States Patent [19]

Whiteside

[11] Patent Number: 5,199,115

[45] Date of Patent: Apr. 6, 1993

[54] BEDPAN RINSING APPARATUS ARM ASSEMBLY SEAL

[75] Inventor: John F. Whiteside, Franklin Park, Ill.

[73] Assignee: Sloan Valve Company, Franklin Park, Ill.

[21] Appl. No.: 779,623

[22] Filed: Oct. 21, 1991

[51] Int. Cl.[5] ..... A61G 9/00

[52] U.S. Cl. ..... 4/300.2; 137/616.7; 285/404

[58] Field of Search ..... 4/300.2; 137/616, 616.7; 277/117, 190; 285/404, 90

[56] References Cited

U.S. PATENT DOCUMENTS

| | | | |
|---|---|---|---|
| 60,178 | 12/1866 | Guynne | 285/404 |
| 562,892 | 6/1896 | Gates et al. | 285/404 X |
| 3,781,040 | 12/1973 | Lasko et al. | 285/404 X |
| 3,855,639 | 12/1974 | Billeter | 4/300.2 |
| 3,855,640 | 12/1974 | Filliung et al. | 4/300.2 |
| 3,964,108 | 6/1976 | Lissau | 4/300.2 |

*Primary Examiner*—William A. Cuchlinski, Jr.
*Assistant Examiner*—W. Morris Worth
*Attorney, Agent, or Firm*—Kinzer, Plyer, Dorn, McEachran & Jambor

[57] ABSTRACT

A diverter mechanism for a bedpan rinsing apparatus includes a diverter valve body and a nozzle pivot mounted within the valve body. A bedpan rinsing arm assembly is positioned within a passage in the nozzle pivot. The improvement is a seal between the nozzle pivot and arm assembly in which the device that locks the arm assembly to the nozzle pivot moves the arm assembly toward the seal as the locking device moves to a locking position.

1 Claim, 2 Drawing Sheets

Fig. 3.
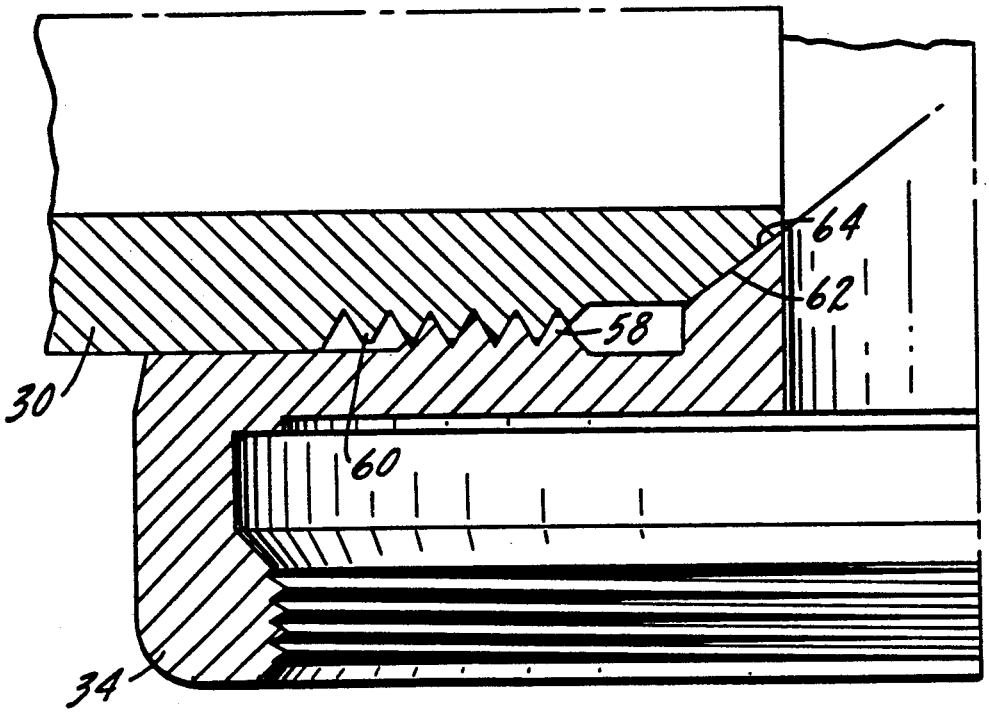
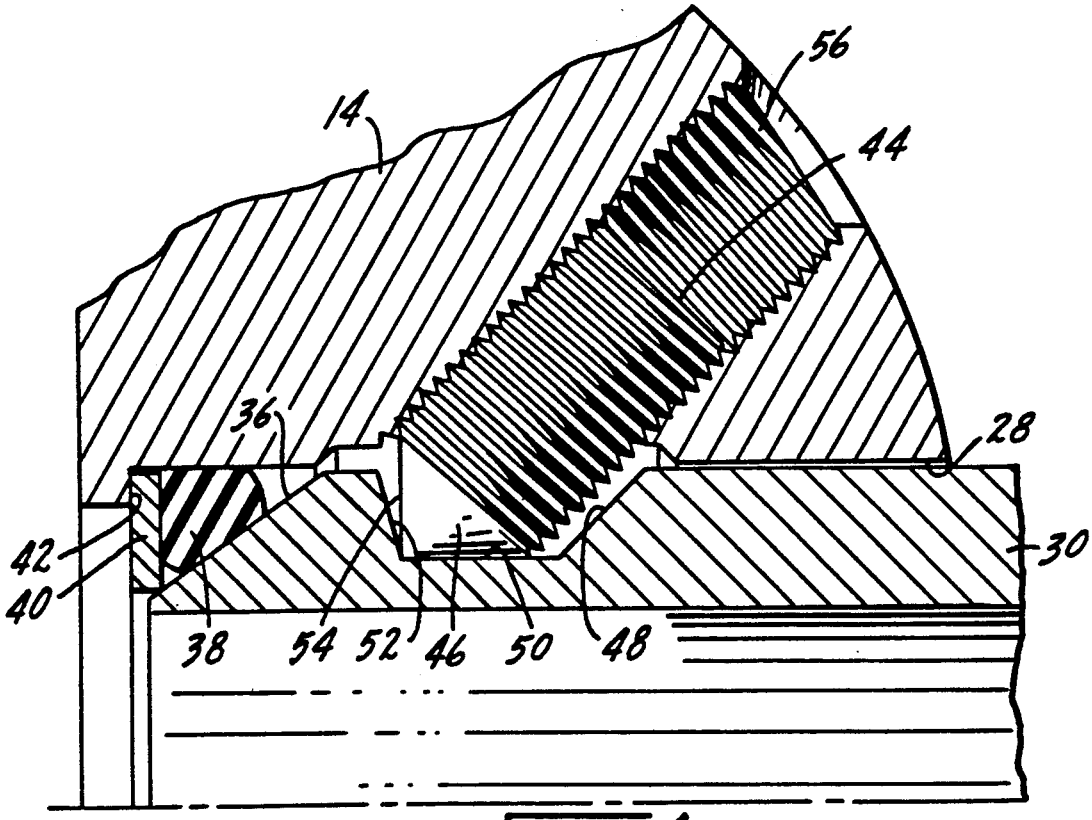
Fig. 4.

BEDPAN RINSING APPARATUS ARM ASSEMBLY SEAL

THE FIELD OF THE INVENTION

The present invention relates to bedpan washers of the type commonly found in hospitals and nursing homes in which the bedpan rinsing apparatus is associated with a toilet flush valve, for example the type of flush valve manufactured by Sloan Valve Company of Franklin Park, Ill., the assignee of the present application. The bedpan rinsing apparatus of this general type includes an arm with a spray nozzle on the end of it, with the arm being mounted to a diverter assembly such that when the arm is in the vertical position, the flush valve, when operated, will cause water to flow into a toilet or commode. When the bedpan rinsing apparatus arm is lowered, the diverter mechanism directs water through the spray nozzle of the rinsing apparatus upon actuation of the flush valve so that a bedpan can be rinsed and its contents deposited in the toilet.

The present invention is more specifically directed to an improved seal for use where the arm assembly attaches to the pivot assembly to minimize potential leaks in the arm assembly.

DESCRIPTION OF THE RELATED ART

This invention relates to a bedpan rinsing apparatus which is associated with a toilet flush valve. There is a diverter mechanism such that when the spray arm of the bedpan rinsing apparatus is lowered for use, a diverter directs water through such spray arm and not through the toilet. U. S. Pat. Nos. 3,855,639, 3,855,640 and 3,964,108, all owned by the assignee of the present application show earlier forms of such devices.

SUMMARY OF THE INVENTION

The present invention relates to a bedpan rinsing apparatus and in particular to the bedpan arm construction and the seal between such construction and the pivotal diverter member which supports it.

A primary purpose of the invention is an improved seal for the use described.

Another purpose of the invention is an improved sealing construction for use in connection with a combination bedpan rinsing apparatus and flush valve.

Other purposes will appear in the ensuing specification, drawings and claims.

BRIEF DESCRIPTION OF THE DRAWINGS

The invention is illustrated diagrammatically in the following drawings wherein:

FIG. 3 is an enlarged partial section of the spray head, and

FIG. 4 is an enlarged partial section illustrating the mounting of the handle assembly.

DESCRIPTION OF THE PREFERRED EMBODIMENT

Figure 1:
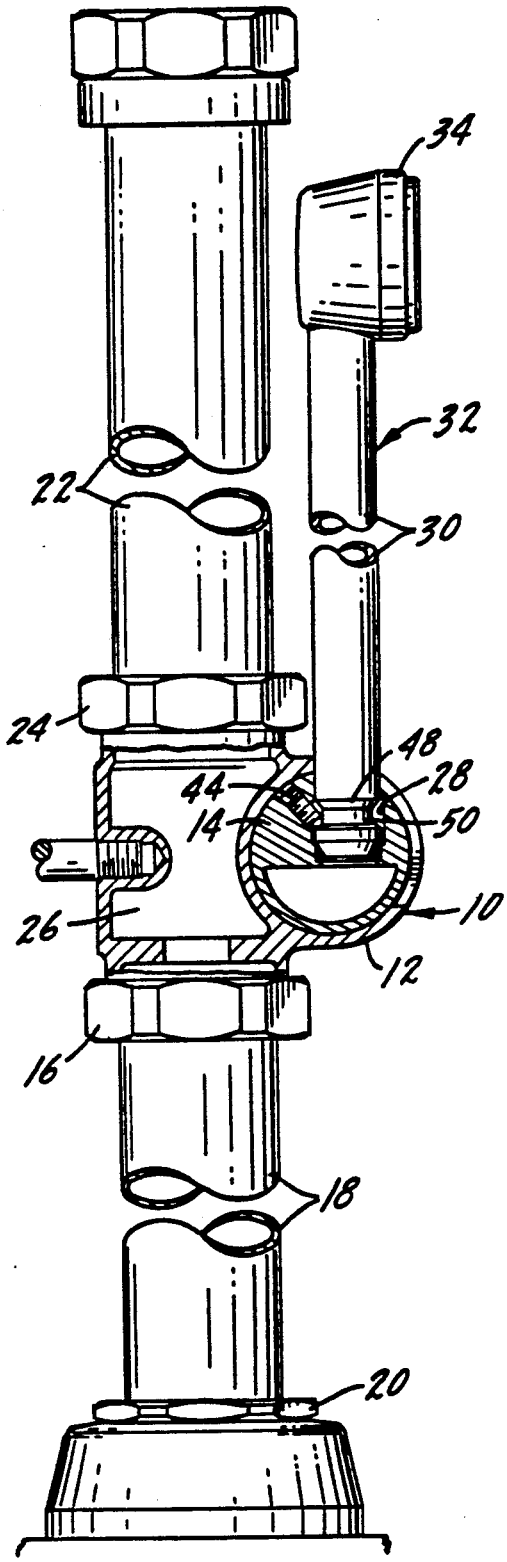
FIG. 1 is a side view, in part section, of a bedpan rinsing apparatus.

The present invention relates to a bedpan rinsing apparatus which is customarily combined with a toilet flush valve, with the combination being used in hospitals and nursing homes with a toilet bowl. The complete construction is not illustrated, nor is the flush valve shown in the drawings and described in the specification. Reference should be made to U.S. Pat. Nos. 3,855,639, 3,855,640 and 3,964,108, for further details. The disclosures of these patents are incorporated by reference herein.

Figure 2:
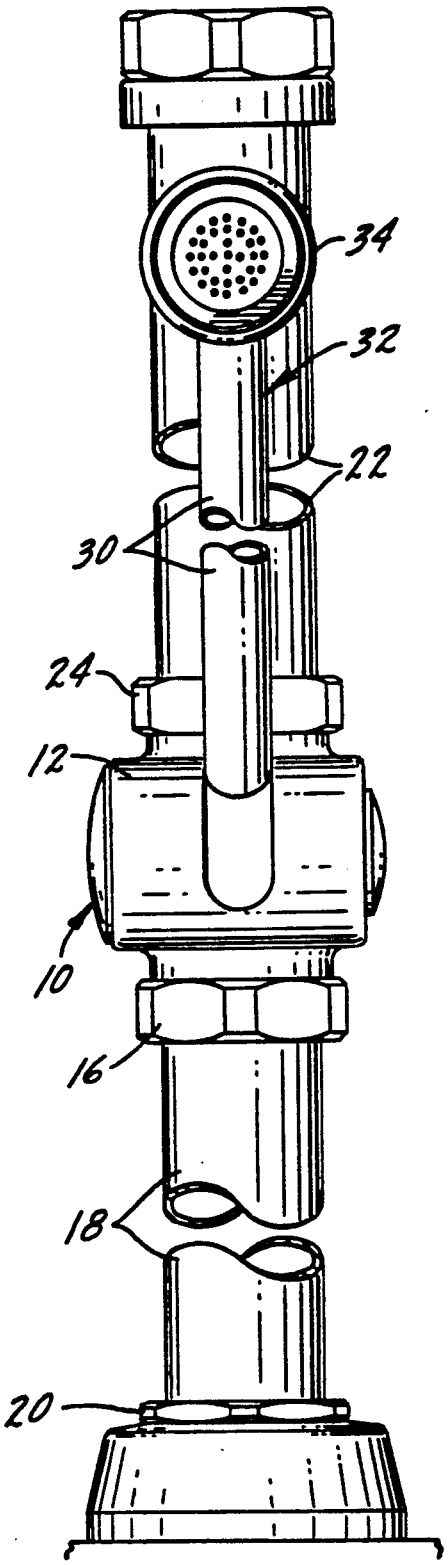
FIG. 2 is a view from the right side of FIG. 1.

In constructions of this type, the bedpan rinsing arm is pivotally mounted on a diverter valve body. When the arm is in the raised position, as shown in FIGS. 1 and 2, no water will flow through it when the toilet flush valve is operated. When the arm is lowered, water is directed through the arm for use in rinsing a bedpan.

In the drawings, a diverter valve body is indicated generally at 10 and has a cylindrical portion 12 within which is mounted a nozzle pivot 14. The diverter valve body is connected by an outlet coupling 16 to an outlet tube 18 which in turn will be attached by coupling 20 to the toilet bowl. Above diverter valve body 10 is a vacuum breaker assembly 22 which is mounted to the diverter body by a coupling 24. The flush valve will be mounted on top of the vacuum breaker assembly 22.

The diverter valve body 10 has an interior chamber 26 within which water flows. When the diverter assembly is in the position shown, water flows directly through body 10 to the toilet bowl. When the arm is moved to a generally horizontal position, a portion of the water is diverted through the arm assembly as described in the above-mentioned patents.

The nozzle pivot 14 has a passage 28 within which is positioned the tube 30 of an arm assembly indicated generally at 32. The arm assembly has a spray nozzle 34 mounted on the end thereof.

As shown more particularly in FIG. 4, tube 30 has a tapered end surface 36 which bears against an annular seal ring 38 held in position by a washer 40. Washer 40, which may be electroplated, is seated upon a shoulder 42 formed within the passage 28 of the nozzle pivot.

The tube 30 is held within passage 28 by a set screw 44 having a nose 46 which extends within a peripheral groove 48 on the exterior of tube 30. Groove 48 has a peripheral or circumferential surface 50 and an adjoining somewhat radial surface 52. In practice, the surface 52 will form an angle slightly greater than 90 degrees with surface 50. Preferably, the angle between these surfaces is approximately 15 degrees greater than 90 degrees, or 105 degrees. One flank 54 of the nose of set screw 44 will initially contact surface 52 in groove 48. As the set screw 44 is turned within its threaded bore 56, the contacting surfaces 52 on tube 30 and flank 54 of nose 46 on set screw 44 will cause the tube 30 to be moved inwardly, compressing seal 38. Continued inward movement of the set screw, after tube 30 has reached-its full inward position shown in FIG. 4, will result in the nose of the set screw biting into the junction between surfaces 52 and 50 in groove 48. The seal 38 is compressed by inward movement of tube 30 into firm contact with washer 40, the interior surface of passage 28 and the tapered end surface 36 of tube 30, thereby forming a complete seal between these three surfaces. The point of the set screw forces the tube to move to this position and the point also bites into the metal of the tube which will prevent subsequent rotation of the arm assembly. In effect, the interengaging action of the metal tip of the set screw and the metal of the tube 30 at the junction between surfaces 50 and 52 will form a resistance to any subsequent rotation of tube 30 and its associated arm assembly.

Also of importance is the manner in which nozzle spray 34 is attached to tube 30. As shown particularly in FIG. 3, the nozzle has a threaded area 58 which mates with a thread 60 on the end of tube 30. Both the tube and the spray nozzle have mating conical surfaces 62 and 64 which function as a metal-to-metal seal between these two elements and also as a stop determining the relative position of these two elements. It may be advantageous to use a small amount of Loc-tite or some other adhesive sealant on the threads to both prevent rotation of the spray head and to form a seal between these two elements.

Whereas the preferred form of the invention has been shown and described herein, it should be realized that there may be many modifications, substitutions and alterations thereto.

The embodiments of the invention in which an exclusive property or privilege is claimed are defined as follows:

1. A diverter mechanism for a bedpan rinsing apparatus including a diverter valve body, a nozzle pivot rotatably mounted within said diverter valve body, an opening in said diverter valve body, a passage in said nozzle pivot, a bedpan rinsing arm assembly including a tube positioned in said nozzle pivot passage and extending through said diverter valve body opening, the improvement comprising means for sealingly attaching said tube to said nozzle pivot within said passage including a stop in said passage, said stop comprising a shoulder formed within said passage and a washer seated upon said shoulder, said washer having a portion extending radially inward of said shoulder and into said passage, an annular seal positioned in said passage against said stop, said tube having a tapered end thereof in contact with said seal, and means for locking said tube in said passage in contact with said seal, said locking means including a bore in said nozzle pivot opening into said passage and forming an acute angle therewith, a peripheral groove on the exterior of said tube, said groove having an axial surface and an adjoining radial surface, with said radial surface forming an angle slightly greater than 90 degrees therewith, a threadedly mounted locking member axially movable in said bore toward said passage and tube, said locking member having a tapered nose thereon which is in flush contact with said groove axial surface with the point of said tapered nose contacting said groove at the junction of said radial and axial surfaces, whereby inward movement of said locking member drives said tube toward said seal with said nose biting into said tube at the junction of said surface to prevent rotation of said arm assembly.

* * * * *